United States Patent [19]

Horansky et al.

[11] Patent Number: 4,541,332

[45] Date of Patent: Sep. 17, 1985

[54] METHOD OF FORMING COMPRESSED BISCUIT HAVING A BEVELED EDGE AND GROOVE FOR INSERTION OF STRAPPING MEANS

[75] Inventors: Frank J. Horansky, Apollo; Eric D. Arndt, New Kensington, both of Pa.

[73] Assignee: Aluminum Company of America, Pittsburgh, Pa.

[21] Appl. No.: 606,936

[22] Filed: May 3, 1984

[51] Int. Cl.[4] ..... B65B 13/02

[52] U.S. Cl. ..... 100/3; 100/35; 100/42; 100/215; 100/232; 100/902; 206/83.5

[58] Field of Search ..... 100/3, 2, 35, 240, 245, 100/295, 902, 215, 232, 42; 206/83.5, 386, 598, 599

[56] References Cited

U.S. PATENT DOCUMENTS

| | | | |
|---|---|---|---|
| 1,376,757 | 5/1921 | Graham | 100/35 |
| 2,570,757 | 10/1951 | Bowman et al. | 100/3 |
| 2,915,208 | 12/1959 | Benschoter | 100/2 X |
| 3,097,741 | 7/1963 | Schwartz | 206/599 X |
| 3,955,492 | 5/1976 | Topolay | 100/215 |
| 4,398,456 | 8/1983 | Prater | 100/902 X |
| 4,483,246 | 11/1984 | Sullivan | 100/902 X |

FOREIGN PATENT DOCUMENTS

| | | | |
|---|---|---|---|
| 2744381 | 4/1979 | Fed. Rep. of Germany | 206/83.5 |

*Primary Examiner*—Billy J. Wilhite

*Attorney, Agent, or Firm*—Glenn E. Klepac

[57] ABSTRACT

A method for converting low-density objects into a bale that is suitable for transportation and storage. A bale made in accordance with the method of the invention comprises a first compressed biscuit having a recessed groove; a second compressed biscuit adjacent the first biscuit and a strapping means inserted into the groove and extending circumferentially around the first and second biscuits. The invention is particularly useful for making bales of compressed biscuits from recycled aluminum containers.

9 Claims, 7 Drawing Figures

METHOD OF FORMING COMPRESSED BISCUIT HAVING A BEVELED EDGE AND GROOVE FOR INSERTION OF STRAPPING MEANS

FIELD OF THE INVENTION

The present invention relates to the compression of low-density objects into compact biscuits in order to facilitate handling, transportation and storage. In a particularly preferred embodiment, the low-density objects are empty aluminum containers that have been collected for shipment to a remelting facility.

BACKGROUND OF THE INVENTION

Methods for compressing low-density objects are known in the prior art. However, each of the prior art methods suffers from one or more serious disadvantages making it less than completely suitable for its intended purpose.

For example, used aluminum containers were previously compressed into biscuits having the shape of a simple rectangular prism. It is difficult to bundle these simple biscuits into suitable bales because metal banding straps have a tendency to slide along the surfaces of such biscuits. In addition, the banding straps holding bales together are occasionally damaged or broken by rough handling because the straps are placed in exposed positions.

It is a principal object of the present invention to provide a method for compressing low-density objects into compact biscuits having recessed grooves for insertion of strapping means.

It is a related object of the invention to provide a method for converting low-density objects into bales that are suitable for handling by mechanized material handling equipment.

Additional objects and advantages of the present invention will become apparent to persons skilled in the art from the following specification with accompanying drawings.

SUMMARY OF THE INVENTION

In accordance with the present invention, low-density objects are transformed into a compressed biscuit that is suitable for bundling into bales. The shape of the biscuit enables it to be strapped together readily with other biscuits having a similar shape. Strapping means holding the bales together are less susceptible to damage compared with bales of biscuits having a simpler configuration. In addition, the bales are suitable for handling by forklift trucks and other mechanized material handling apparatus.

The crushing apparatus used for practicing our invention includes a chamber having a base wall, a side wall extending outwardly from the base wall, and a mouth opening defined by the side wall and spaced outwardly from the base wall. A first plurality of low-density objects is inserted through the mouth opening into the chamber and compressed by applying force to a crusher having a platen. The platen is provided with a principal surface opposed to the base wall and a protuberance extending inwardly from the principal surface toward the base wall. The protuberance comprises first and second lateral portions.

Compression with the platen forms a first biscuit having a density greater than the density of the low-density objects inserted into the chamber. The protuberance forms in a first wall of the biscuit a recessed groove that is suitable for insertion of a strapping means. The first biscuit further comprises a second wall adjacent to the base wall of the chamber. The first biscuit is then removed from the chamber.

A compressed second biscuit is formed by compressing a second plurality of low-density metal objects in the chamber. The second biscuit is removed from the chamber.

The first and second biscuits are then positioned adjacent to each other with the second wall of the first biscuit next to the second biscuit and the first wall of the first biscuit spaced away from the second biscuit.

A first strapping means is inserted into the groove. The first strapping means extends circumferentially around both biscuits. The two biscuits are then bound into a bale by fastening the first strapping means securely.

In a preferred method, the platen further includes a crosspiece extending inwardly from the principal surface and transversely of the protuberance. Compressing the crosspiece against a biscuit forms in the first wall a recessed slot that is suitable for insertion of a strapping means. A second strapping means inserted into the slot and extending circumferentially around the first and second biscuits binds the bale together more securely.

A preferred platen comprises a first chamfer extending inwardly and laterally from the principal surface toward the side wall of the chamber. The first chamfer forms in the biscuits a first bevel extending obliquely inwardly and laterally from the first wall toward the side wall.

The chamber of the crushing apparatus may also be provided with a second chamfer extending obliquely from the base wall toward the side wall. The second chamfer forms in the biscuits a second bevel extending obliquely outwardly and laterally from the second wall toward the side wall.

The method of the invention is specifically adapted for compressing empty aluminum containers but may find application with respect to other low-density objects as well. Low-density objects such as empty steel or plastic containers may also be compressed by the method of the invention. The empty aluminum containers usually have a density of about 1.7 $lb/ft^3$ and they are compressed into biscuits having a density of about 20 to 60 $lb/ft^3$. A preferred biscuit has a density of about 35 to 45 $lb/ft^3$.

The first and second strapping means used for binding biscuits together comprise metal straps or wires. Steel banding straps are preferred. Strapping means made from aluminum or aluminum alloys have the advantage of being suitable for recycling along with the compressed biscuits.

DETAILED DESCRIPTION OF A PREFERRED EMBODIMENT

Figure 1:
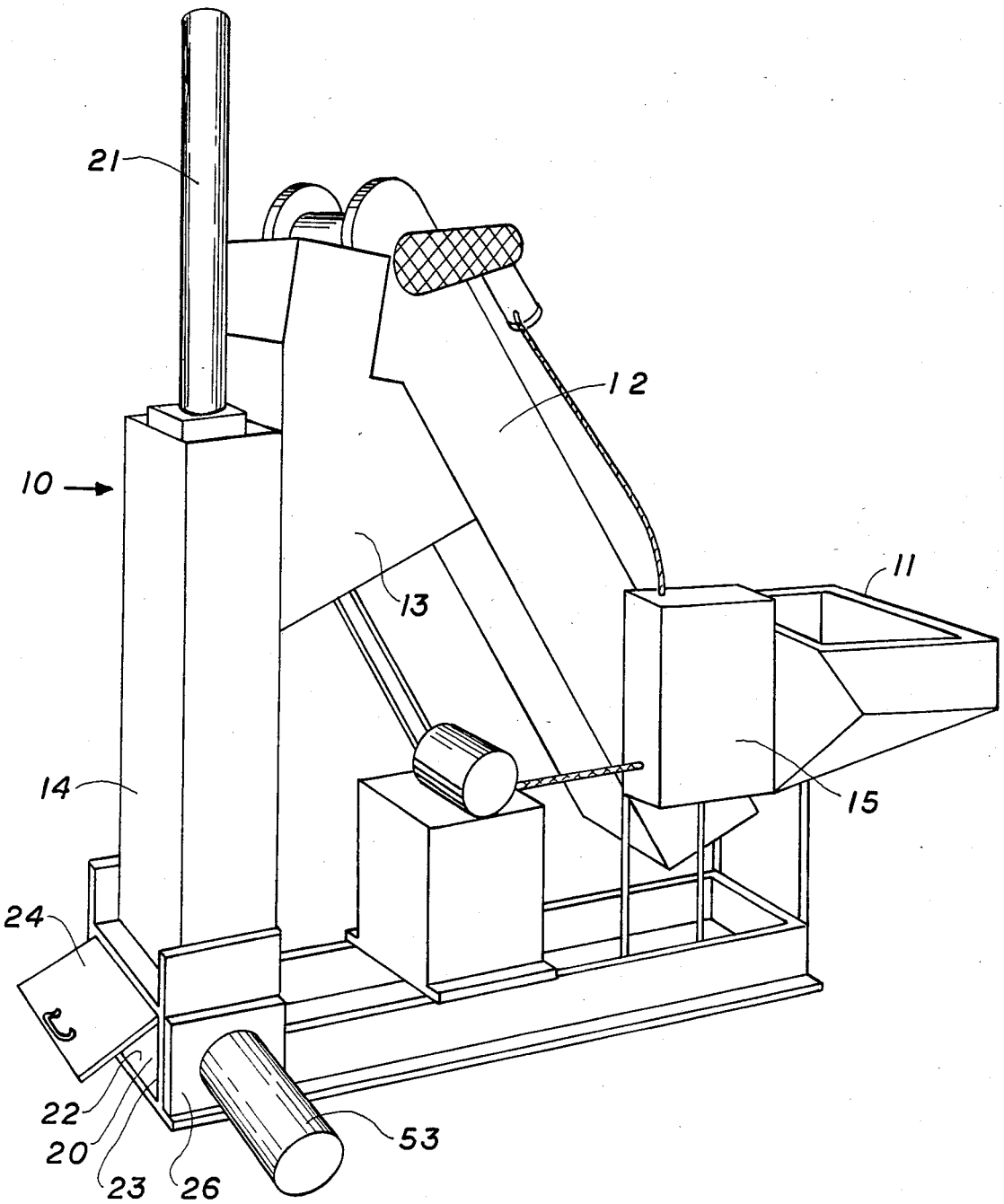
FIG. 1 is a perspective view of a crushing apparatus for making compressed biscuits from empty metal containers in accordance with the present invention.

A preferred crushing apparatus 10 for making compressed biscuits from low-density objects in accordance with the present invention is illustrated in FIG. 1. The apparatus 10 includes a hopper 11 for receiving metal containers or other low-density objects, a motor driven conveyor 12 for carrying the containers upwardly and laterally from the hopper 11, a chute 13 communicating with the conveyor 12 at its upper end and a container crusher 14 receiving containers from the chute 13. The chute 13 may include a weighing device (not shown) for controlling the quantity of containers passing from the conveyor 12 to the crusher 14. Controlling the flow of containers in this manner improves consistency of the finished biscuits. A control box 15 controls the supply of power to the conveyor 12 and crusher 14.

The crusher 14 includes a chamber 20 and a hydraulic cylinder or first cylinder 21 for compressing metal containers or other low-density objects against a base wall or floor 22. Biscuits of compressed metal containers are removed or ejected from the crusher 14 through a front opening 23 by opening a door 24.

Figure 2:
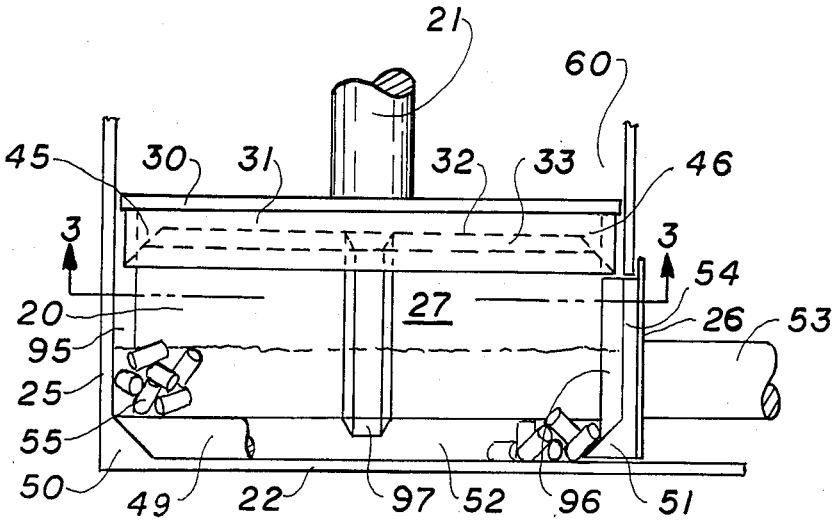
FIG. 2 is a schematic fragmentary front elevational view of the can crushing apparatus of FIG. 1.
Figure 3:
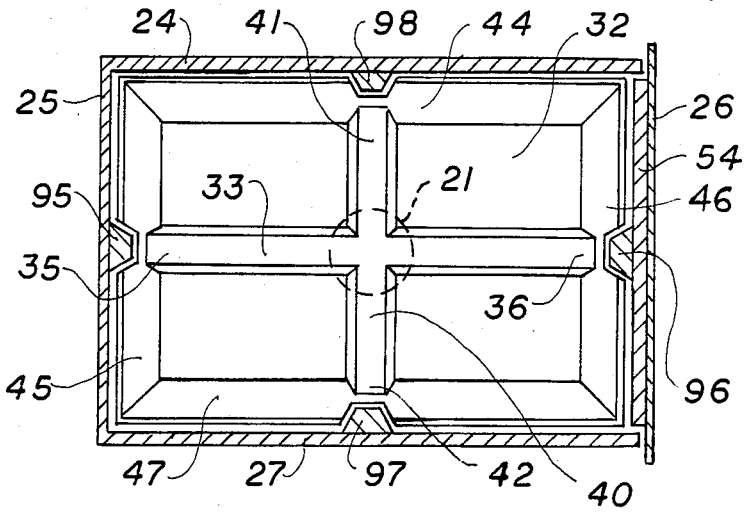
FIG. 3 is a cross-sectional view taken along the lines 3—3 of FIG. 2.

Referring now to FIGS. 1, 2 and 3, the chamber 20 has a side wall or side wall means 24, 25, 26, 27 extending upwardly from the base wall 22. In the preferred embodiment shown, the side wall includes a front wall or door 24, two lateral walls 25, 26 and a rear wall 27, all of which extend upwardly generally normal to the base wall 22. In addition, the base wall 22 is generally rectangular and comprises a horizontally extending floor for the chamber 20. If desired, the base wall 22 may have a different shape or may be arranged in a vertical or slanted direction without departing from the spirit and scope of our invention.

The crusher 14 includes a platen or first platen 30 affixed to the cylinder 21. As shown in FIGS. 2 and 3, the platen 30 comprises a principal portion 31 having a generally planar principal surface 32 opposed to the base wall 22. The principal portion 31 comprises a generally rectangular steel plate and is connected to a downwardly extending steel protuberance 33 by a set of bolts (not illustrated). The principal portion 31 may be attached to the protuberance 33 by other preferred mechanical fastening means, or the two pieces may be welded together.

The protuberance 33 extends transversely between the first lateral wall 25 and second lateral wall 26, generally parallel to the front wall 24 and rear wall 27. The protuberance comprises a first lateral portion 35 proximal to the first end wall 25 and a second lateral portion 36 proximal to the second end wall 26.

The preferred platen 30 shown in FIGS. 2 and 3 also comprises a crosspiece 40 extending transversely of the protuberance 33 generally parallel to the lateral walls 25, 26. The crosspiece 40 has a front or first end portion 41 proximal to the front wall 24 and a rear or second end portion 42 proximal to the rear wall 27.

The platen 30 further comprises four top chamfers or first chamfers 44, 45, 46, 47, extending downwardly and laterally from the principal surface 32 toward the side walls 24, 25, 26, 27. The first chamfers 44, 45, 46, 47, are shown in FIG. 3.

The chamber 20 also includes four bottom chamfers or second chamfers 49, 50, 51, 52 extending upwardly and laterally from the floor 22 toward the side walls 24, 25, 26, 27. The second chamfers 49, 50, 51, 52 are shown in FIG. 2.

The preferred apparatus 10 shown in FIGS. 1 and 2 further comprises a side cylinder or second cylinder 53 attached to a side platen or second platen 54.

Referring now to FIGS. 1, 2 and 3, the method of the invention is practiced by conveying metal containers 55 from the hopper 11 upwardly and laterally in the conveyor 12 and then downwardly through the chute 13. The metal containers 55 are preferably unflattened aluminum beverage cans having an aggregate density of about 1.7 $lb/ft^3$ (equivalent to about 27 $kg/m^3$). The method and apparatus described herein are also suitable for making compressed biscuits from other low-density objects such as scrap aluminum foil, empty steel cans, plastic bottles and other plastic containers. The containers 55 are dumped from the chute 13 and inserted through a mouth opening 60 into the chamber 20. The containers 55 then comprise a first plurality of low-density objects lying adjacent to the base wall 22 (see FIG. 2).

Next, the cylinder 21 moves the platen 30 toward the base wall 22, thereby compressing the containers 55. The dumping and compressing steps are repeated as many times as necessary to form a first biscuit of desired size and weight. A particularly preferred biscuit is made by successively dumping and compressing three loads of aluminum containers 55 in the chamber 20. Fewer dumps and compressions are generally required when the chamber 20 is enlarged or when flat containers are utilized instead of unflattened containers. Weight, density and size of the biscuit can be varied considerably by controlling the quantity of containers in each dump and/or the total number of dumps.

When the apparatus includes a side cylinder 53 as shown in FIGS. 1 and 2, the biscuit is compressed from the side after all compressions by the first platen 30 have been completed. This side compression step is performed with the first platen 30 fixed in place, adjacent the containers 55. Compression by a side platen 54 in addition to the first platen 30 generally makes more cohesive and higher density biscuits than when only a single cylinder 21 compresses the containers 55.

Finally, a completed biscuit is removed or ejected from the chamber 20. Depending upon capabilities of the apparatus 10, the biscuit may be removed or ejected frontwardly through the front opening 23; upwardly through the mouth opening 60 or downwardly by lowering of the base wall 22.

Figure 4:
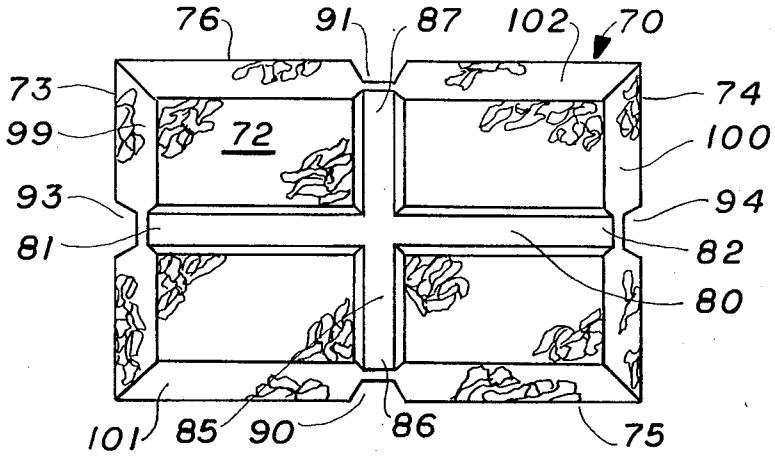
FIG. 4 is a top plan view of a compressed biscuit made in accordance with the present invention.
Figure 6:
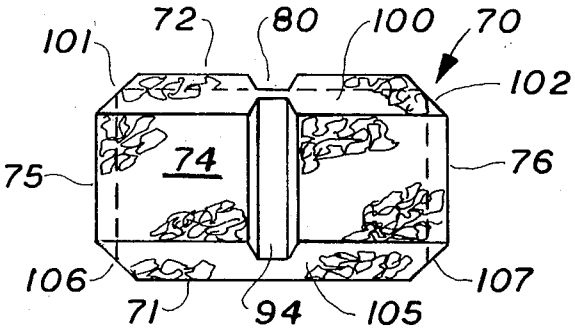
FIG. 6 is a side elevational view of the biscuit of FIG. 4.
Figure 5:
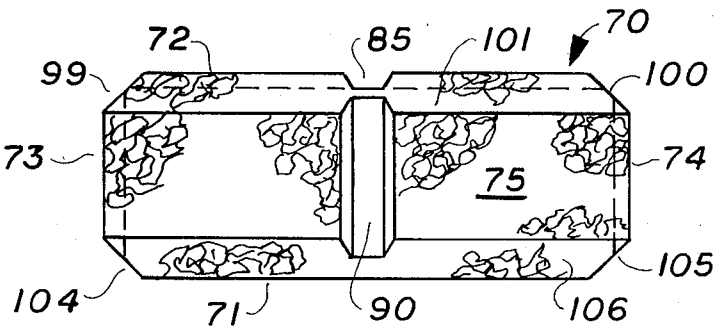
FIG. 5 is a front elevational view of the biscuit of FIG. 4.

A particularly preferred biscuit or first biscuit 70 made in accordance with the present invention is illustrated in FIGS. 4, 5 and 6. The biscuit 70 comprises a plurality of layers of crushed containers joined to one another in accordance with the method described above. The biscuit 70 generally has the shape of an upright rectangular prism and comprises a lower wall 71, an upper wall 72 spaced upwardly from the lower wall 71, and first and second end walls 73, 74 extending between the lower wall 71 and upper wall 72. A front wall or front biscuit wall 75 and a rear wall or rear biscuit wall 76 extend between the end walls 73, 74.

The protuberance 33 of the platen 30 forms in the upper wall 72 a recessed groove 80 that is suitable for insertion of a strapping means or banding strap. The groove 80 extends between the end walls 73, 74 and includes a first end portion 81 adjacent the first end wall 73 and a second end portion 82 adjacent the second end wall 74.

The crosspiece 40 forms in the upper wall 72 a recessed slot 85 that is suitable for insertion of a strapping means or banding strap. The slot includes a front end portion 86 adjacent the front biscuit wall 75 and a rear end portion 87 adjacent the rear biscuit wall 76.

The preferred biscuit 70 described herein has a groove 80 and slot 85 only in the upper wall 72. If desired, a groove and a slot may also be formed in the lower wall 71.

The preferred biscuit 70 shown also includes a recessed front channel 90 in the front wall 75 and a recessed rear channel 91 in the rear wall 76. The channels 90, 91 each comprise an upper end portion adjacent to the slots 85. The channels 90, 91 are sufficiently wide and deep to be suitable for insertion of a strapping means or banding strap.

The biscuit 70 further comprises a recessed first furrow 93 in the first end wall 73 and a recessed second furrow 94 in the second end wall 74. The furrows 93, 94 each comprise an upper end portion adjacent to the groove 80. The furrows 93, 94 have sufficient width and depth to be suitable for insertion of a strapping means or banding strap.

The channels 90, 91 and furrows 93, 94 mentioned above are formed in the biscuit 70 by suitable vertical ribs affixed to side walls 24, 25, 26, 27 of the chamber 20 in the crusher 14. These ribs 95, 96, 97, 98 are shown in FIGS. 2 and 3.

The four top chamfers 45, 46, 47, 48 form in the biscuit 70 a set of four top bevels or first bevels 99, 100, 101, 102 extending downwardly and laterally from the upper wall 72 toward the end walls 73, 74, front biscuit wall 75 and rear biscuit wall 76. The four bottom chamfers 49, 50, 51, 52 form in the biscuit 70 a set of four bottom bevels or second bevels 104, 105, 106, 107 extending upwardly and laterally from the lower wall 71 toward the end walls 73, 74, front biscuit wall 75 and rear biscuit wall 76. The top bevels 99, 100, 101, 102 and bottom bevels 104, 105, 106, 107 make the biscuit 70 easier to stack in layers and safer to handle by reducing the incidence of sharp container edge portions flashing or protruding from the biscuit walls.

A biscuit made in accordance with our invention from empty aluminum containers has a density of about 20 to 60 lb/ft$^3$ (equivalent to about 320 to 960 kg/m$^3$). The preferred density range is about 35 to 45 lb/ft$^3$ (equivalent to about 560 to 720 kg/m$^3$). A particularly preferred biscuit has a density of about 40 lb/ft$^3$ (equivalent to about 640 kg/m$^3$).

Figure 7:
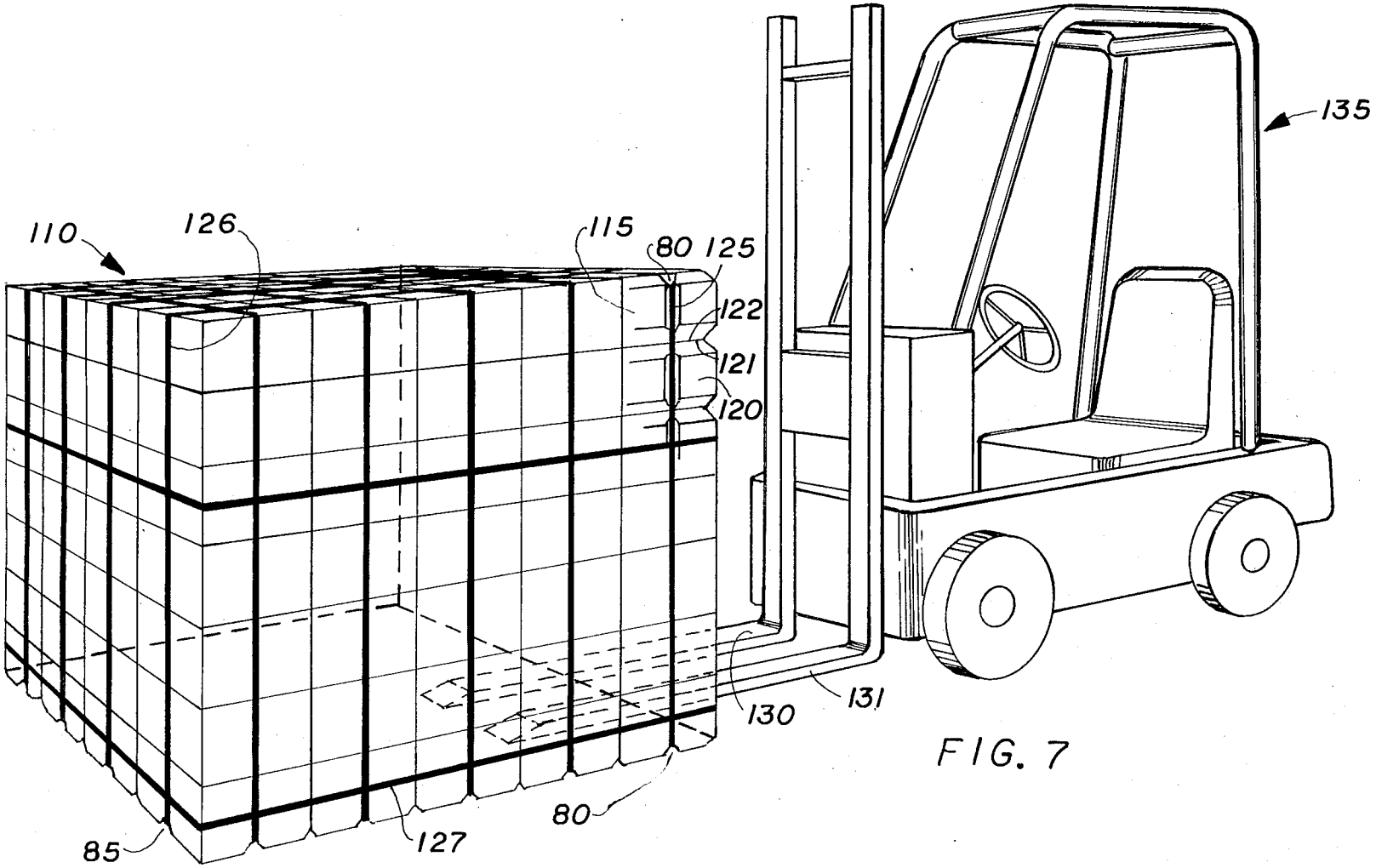
FIG. 7 is a perspective view of a bale of compressed biscuits made in accordance with the invention.

In FIG. 7, there is shown a method for binding and transporting a bale 110 comprising 140 biscuits stacked together in seven layers of 20 biscuits per layer. The bale 110 includes a first biscuit 115 and a second compressed biscuit 120 stacked below the first biscuit 115. The second biscuit 120 is also formed by compressing metal containers and it includes a top wall 121 adjacent to a lower wall 122 of the first biscuit 115.

The bale 110 is made by placing a bottom layer of 20 biscuits on a floor with their grooves 80 and slots 85 facing downwardly. Five layers of 20 biscuits each are next stacked on top of the bottom layer. Finally, a top layer is formed by stacking 20 biscuits with their grooves 80 and slots 85 opening upwardly.

The bale 110 is held together by three separate sets of strapping means or banding straps. Five first banding straps 125 are inserted within grooves 80 in the top and bottom layers of biscuits and extend circumferentially around the bale 110. Four second banding straps 126 are inserted within slots 85 in the top and bottom layers of biscuits and extend circumferentially around the bale 110, generally transverse to the first banding straps 125. In addition, two third banding straps 127 extend horizontally around the bale 110 with a vertical spacing of several inches between them.

The strapping means 125, 126, 127 may comprise either plastic, steel, aluminum or other metals. In the preferred bale 110 shown in FIG. 7, the strapping means 125, 126, 127 are flat steel bands having a width of about 0.75 inch and a thickness of about 0.030 inch.

The strapping means may comprise either aluminum wire or flat aluminum bands. If aluminum wire is chosen, it must be of sufficiently heavy gauge to resist the springback from a highly compressed bale of compressed biscuits. It has been found that 0.135 inch diameter (10 gauge) and 0.140 inch diameter 5056-0 alloy, and 0.150 inch diameter Alclad 5056-0 alloy aluminum wire all perform satisfactorily in securing bales of compressed biscuits.

Bales of compressed biscuits may be secured together with aluminum banding straps rather than wire. Bands having a width of about 0.75 inch and about 0.030 inch thickness of 5052 aluminum alloy in an H36 temper are satisfactory. Wider bands of thinner material may be substituted as well as narrower bands of thicker material. Aluminum strapping means have the advantage of being suitable for recycling together with the biscuits without adding undue concentrations of impurities, such as iron, which may result when steel straps are used.

In FIG. 7, there is shown a technique for transporting a bale 110 comprising 140 biscuits. The bale 110 is supported on tines 130, 131 extending laterally from a forklift truck 135. Bevels on biscuits adjacent the floor enable the tines 130, 131 to slide underneath the bale 110 without damaging it. In addition, grooves 80 and slots 85 in biscuits adjacent the floor protect the banding straps 125, 126 from damage by the tines 130, 131. Channels and furrows in the biscuits protect the banding straps 125, 126 from damage by abrasion against other bales.

The foregoing detailed description of our invention has been made with reference to a single preferred embodiment. Persons skilled in the art will understand that numerous changes and modifications may be accomplished without departing from the spirit and scope of the following claims.

What is claimed is:

1. A method for converting low-density objects into a bale that is suitable for transportation and storage, comprising (a) providing a chamber having a base wall, a side wall extending outwardly from said base wall, said side wall defining a mouth opening spaced outwardly from said base wall, (b) inserting a first plurality of low-density objects through said mouth opening and into said chamber, (c) compressing said low-density objects by applying force to a crusher having a platen provided with a principal surface opposed to said base wall and a protuberance extending inwardly from said principal surface toward said base wall, said protuberance comprising a first lateral portion and a second lateral portion spaced from said first lateral portion, said platen further comprising a first chamfer extending obliquely inwardly and laterally from said principal surface toward said side wall, said platen forming a compressed first biscuit having a density greater than the density of said objects inserted into the chamber in step (b), said platen forming in said first biscuit a first wall including a recessed groove suitable for insertion of a strapping means, said first chamfer forming in said first biscuit a first bevel extending obliquely inwardly and laterally from said first wall toward said side wall, said first biscuit further comprising a second wall spaced inwardly from said first wall and adjacent said base wall of the chamber, (d) forming a compressed second biscuit by compressing a second plurality of low-density objects, (e) positioning said first and second biscuits adjacent one another with said second wall adjacent said second biscuit and said first wall spaced from said second biscuit, (f) inserting a first strapping means into said groove, said first strapping means extending circumferentially around said first and second biscuits, and (g) binding said first and second biscuits into a bale by fastening said first strapping means to said biscuits.

2. The method of claim 1 wherein said base wall and side wall of the chamber include a second chamfer extending outwardly and laterally from the base wall toward the side wall, and wherein step (c) further comprises compressing the second wall of the first biscuit against said second chamfer to form in said biscuit a second bevel extending obliquely outwardly and laterally from said second wall toward said side wall.

3. The method of claim 1 wherein said platen further comprises a crosspiece extending inwardly from said principal surface toward said base wall, said crosspiece extending transversely of said protuberance and comprising a front end portion adjacent said side wall and a rear end portion spaced from said front end portion, said method further comprising (h) compressing said crosspiece against the first wall of the first biscuit to form a recessed slot extending across said first wall transversely of said groove, said slot being suitable for insertion of a strapping means, (i) inserting a second strapping means into said slot, said second strapping means extending circumferentially around said first and second biscuits, and (j) binding said first and second biscuits together more securely by fastening said second strapping means to said biscuits.

4. The method of claim 3 wherein said second strapping means comprises aluminum wire or an aluminum banding strap.

5. The method of claim 3 wherein said second strapping means comprises a banding strap of aluminum 5052 alloy having a width of about 0.75 inch and a thickness of about 0.030 inch.

6. The method of claim 1 wherein said low-density objects are aluminum containers and said biscuits each have a density of about 20 to 60 $lb/ft^3$.

7. The method of claim 6 wherein said biscuits each have a density of about 35 to 45 $lb/ft^3$.

8. The method of claim 1 wherein said first strapping means comprises aluminum wire or an aluminum banding strap.

9. The method of claim 1 wherein said first strapping means comprises a banding strap of aluminum 5052 alloy having a width of about 0.75 inch and a thickness of about 0.030 inch.

* * * * *